US009697767B2

(12) United States Patent
Tan et al.

(10) Patent No.: US 9,697,767 B2
(45) Date of Patent: Jul. 4, 2017

(54) LED PIXEL UNIT CIRCUIT, DRIVING METHOD THEREOF, AND DISPLAY PANEL

(71) Applicants: BOE TECHNOLOGY GROUP CO., LTD., Beijing (CN); CHENGDU BOE OPTOELECTRONICS TECHNOLOGY CO., LTD., Chengdu, Sichuan (CN)

(72) Inventors: Wen Tan, Beijing (CN); Xiaojing Qi, Beijing (CN)

(73) Assignees: BOE TECHNOLOGY GROUP CO., LTD., Beijing (CN); CHENGDU BOE OPTOELECTRONICS TECHNOLOGY CO., LTD., Chengdu, Sichuan (CN)

( * ) Notice: Subject to any disclaimer, the term of this patent is extended or adjusted under 35 U.S.C. 154(b) by 364 days.

(21) Appl. No.: 14/366,881

(22) PCT Filed: Oct. 15, 2013

(86) PCT No.: PCT/CN2013/085242
§ 371 (c)(1),
(2) Date: Jun. 19, 2014

(87) PCT Pub. No.: WO2015/003434
PCT Pub. Date: Jan. 15, 2015

(65) Prior Publication Data

US 2016/0071458 A1 Mar. 10, 2016

(30) Foreign Application Priority Data

Jul. 8, 2013 (CN) ..... 2013 1 0284757

(51) Int. Cl.
*G09G 3/32* (2016.01)
*G09G 3/3233* (2016.01)

(52) U.S. Cl.
CPC ... *G09G 3/3233* (2013.01); *G09G 2300/0814* (2013.01); *G09G 2300/0819* (2013.01);
(Continued)

(58) Field of Classification Search
CPC ..... G09G 3/3233; G09G 2300/0814; G09G 2300/0819; G09G 2300/0842;
(Continued)

(56) References Cited

U.S. PATENT DOCUMENTS

2005/0237283 A1* 10/2005 Ozawa et al. ..... G09G 3/3233 345/76
2007/0273620 A1* 11/2007 Yumoto ..... G09G 3/3233 345/76

FOREIGN PATENT DOCUMENTS

CN 1691116 A 11/2005
CN 101140731 A 3/2008
(Continued)

OTHER PUBLICATIONS

Second Chinese Office Action Appln. No. 201310284757.3; Dated Jul. 14, 2015.
(Continued)

*Primary Examiner* — Hong Zhou
(74) *Attorney, Agent, or Firm* — Ladas & Parry LLP

(57) ABSTRACT

Provided are an AMOLED pixel unit circuit, a driving method thereof and a display panel for realizing the threshold voltage compensation. The AMOLED pixel unit circuit includes: a light emitting module: a driving module configured to drive the light emitting module; a light emitting control module configured to control the light emitting module to emit light; a threshold compensation module configured to perform threshold voltage compensation for the driving module; a data voltage writing module configured to input a data voltage to the driving module; and an
(Continued)

initialization module configured to initialize the threshold compensation module. The threshold voltage compensation is realized by modifying the pre-charging fashion to fixedly set the gate of the driving TFT to be at a data level lower than the high level such that the subthreshold saturation cutoff state is reached before the drain-source voltage becomes zero in the compensation stage.

20 Claims, 7 Drawing Sheets

(52) U.S. Cl.
CPC ..... *G09G 2300/0842* (2013.01); *G09G 2300/0861* (2013.01); *G09G 2320/043* (2013.01)

(58) Field of Classification Search
CPC ..... G09G 2300/0861; G09G 2320/043; G09G 2320/045
USPC ..... 345/76
See application file for complete search history.

(56) References Cited

FOREIGN PATENT DOCUMENTS

| | | | |
|---|---|---|---|
| CN | 102346999 | A | 2/2013 |
| CN | 203311818 | U | 11/2013 |
| KR | 20130009487 | A | 1/2013 |

OTHER PUBLICATIONS

International Preliminary Report on Patentability issued Jan. 12, 2016; PCT/CN2013/085242.
International Search Report Appln. No. PCT/CN2013/085242, Dated Apr. 16, 2014.
First Chinese Offics Action Appln. No. 201310284757.3; Dated Mar. 26, 2015.
Chinese Patent Grant Notification issued Dec. 8; 2015; Appln. No. 201310284757.3.

* cited by examiner

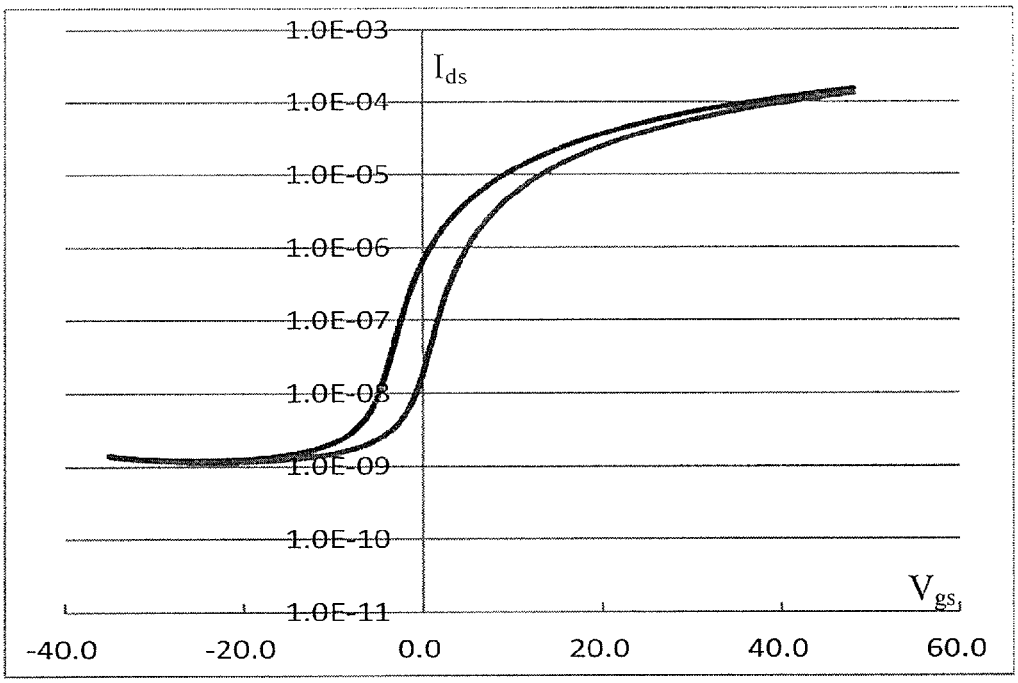
Figure 2
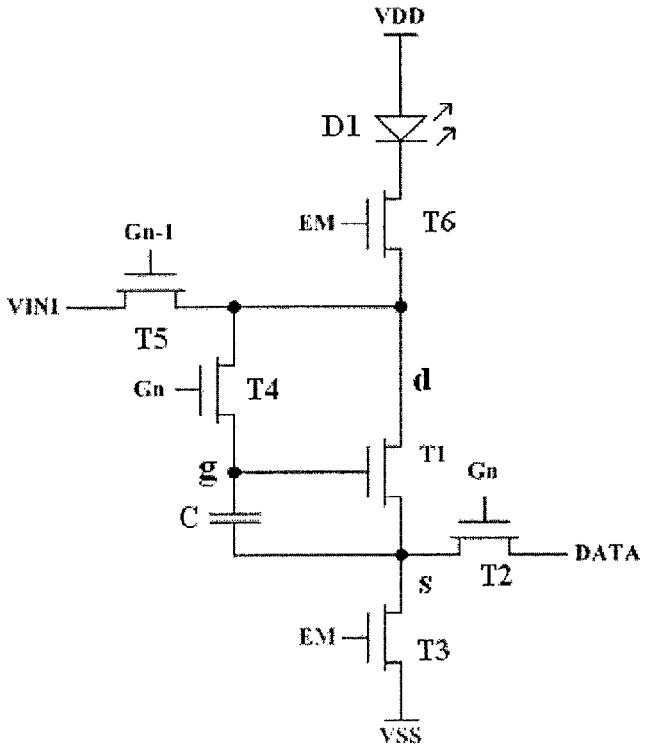
Figure 3（a）

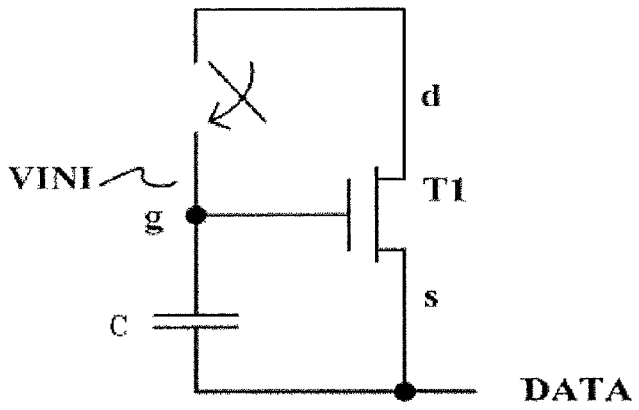
Figure 3（b）
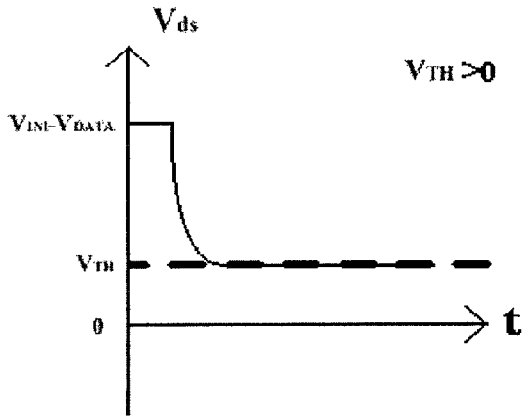
Figure 4（a）
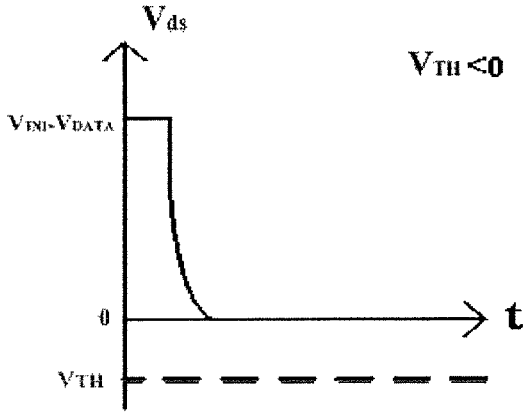
Figure 4（b）

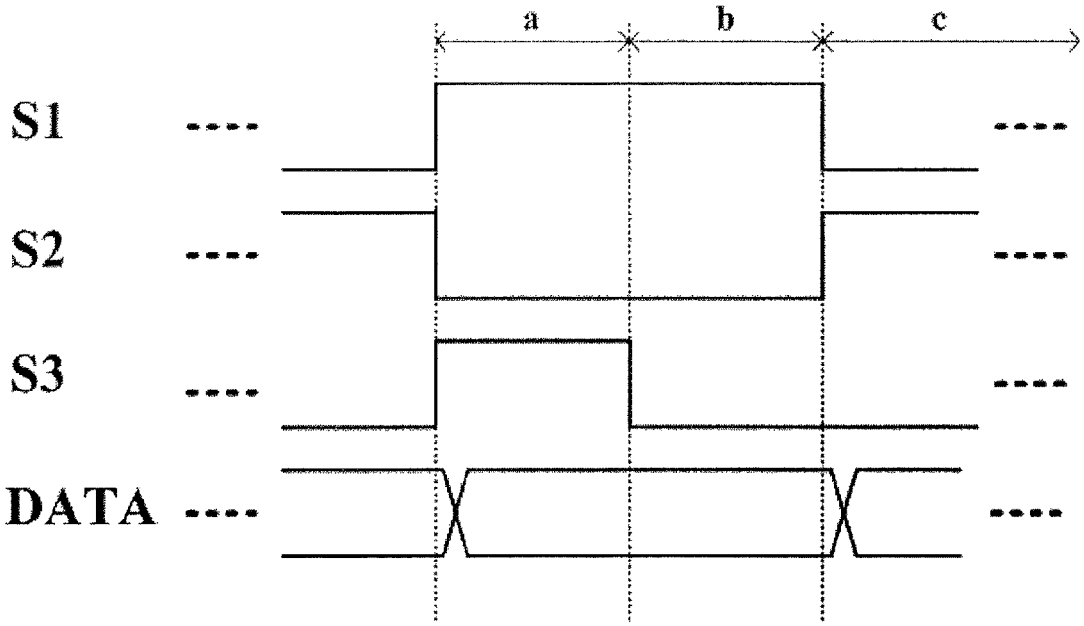
Figure 6
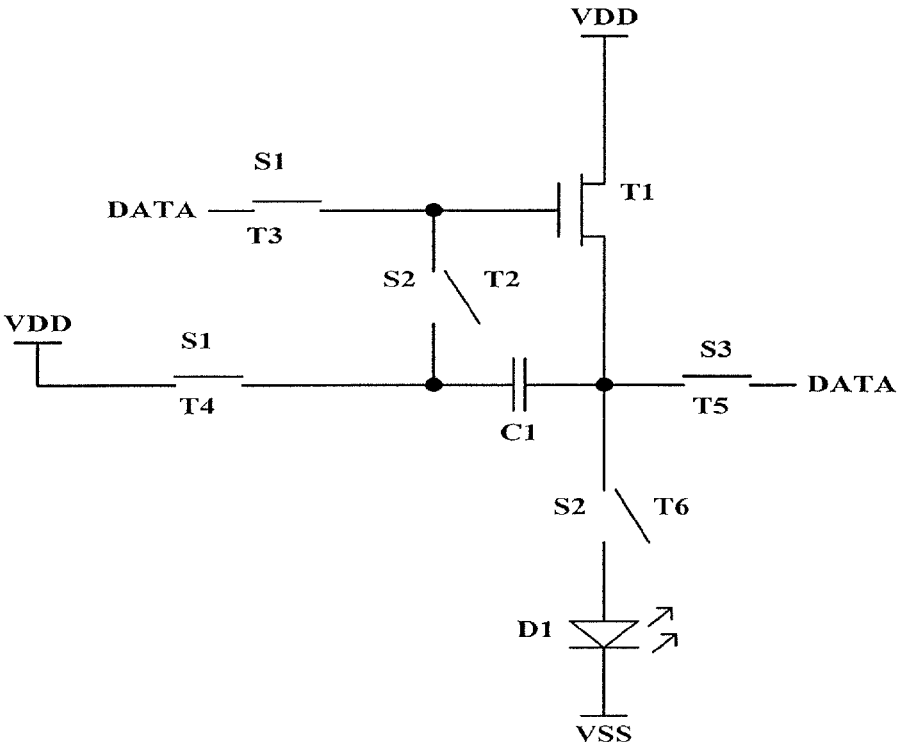
Figure 7（a）

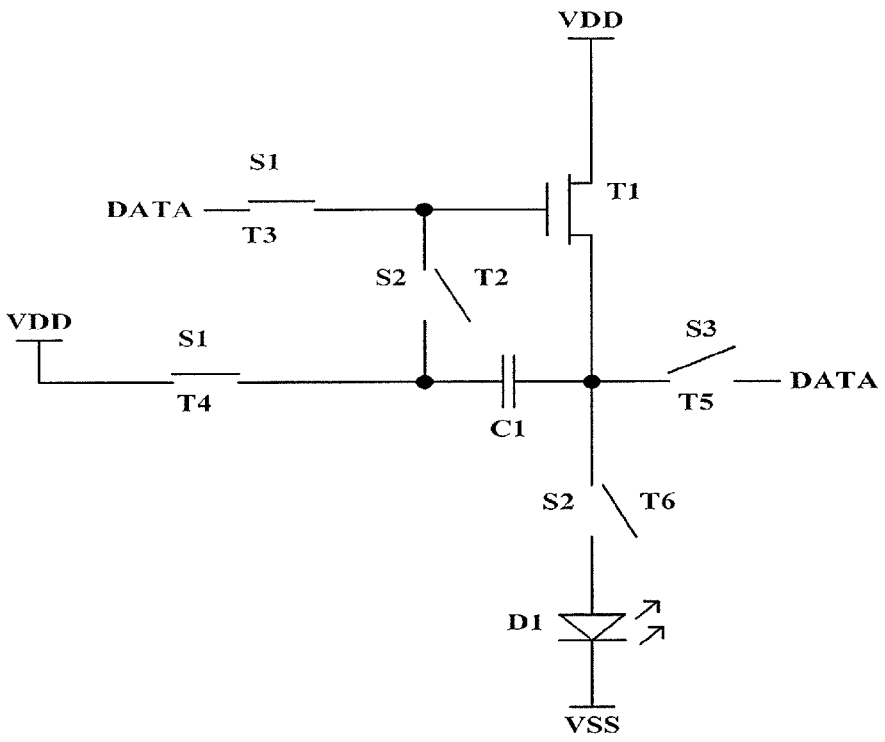
Figure 7（b）
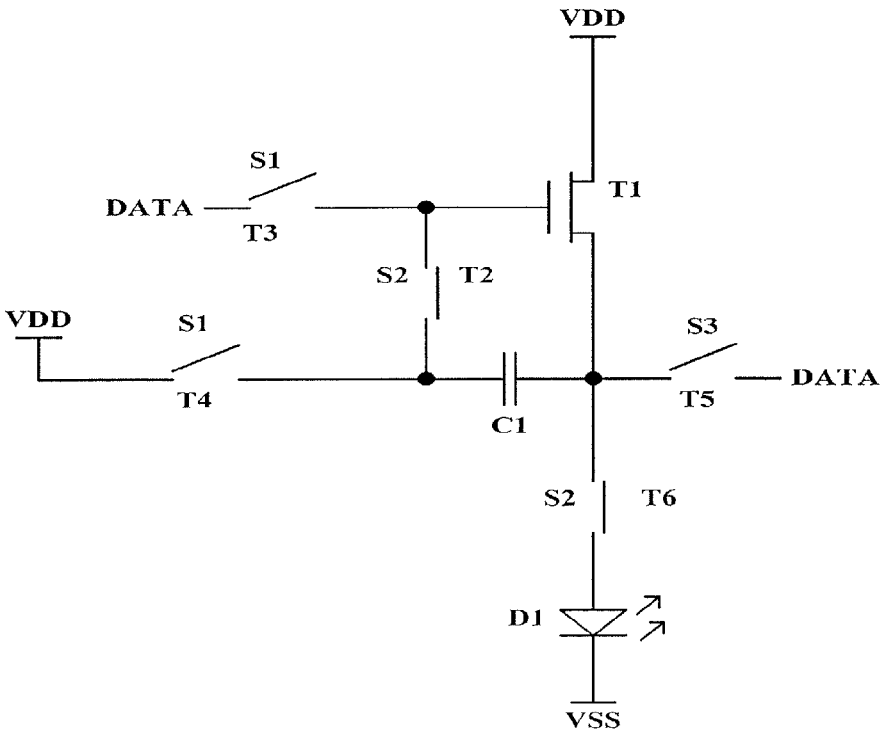
Figure 7（c）

LED PIXEL UNIT CIRCUIT, DRIVING METHOD THEREOF, AND DISPLAY PANEL

TECHNICAL FIELD OF THE DISCLOSURE

The present disclosure relates to the field of display technology, and particularly to a light emitting diode (LED) pixel unit circuit, a driving method thereof, and a display panel.

BACKGROUND

In the field of display technology, the Active Matrix Organic Light Emitting Diode (AMOLED) display apparatus has been drawing people's attention gradually due to its many advantages such as being super thin, good quake resistance, large visual angle, short response time, good performance at low temperature, high emission efficiency, capability of being made into flexible display, etc. FIG. 1(*a*) is a basic pixel circuit structure for driving an AMOLED by N type Thin Film Transistors (TFTs) as known in the art, and FIG. 1(*b*) is a basic pixel circuit structure for driving an AMOLED by P type TFTs as known in the art. In FIG. 1(*a*) and FIG. 1(*b*), VDATA is a data level signal, VSCAN is a scan signal, VDD is a high voltage level signal, VSS is a low voltage level signal, T1 and T2 are TFTs, C1 is a capacitor, and D1 is a LED. The circuits in FIG. 1(*a*) and FIG. 1(*b*) is applicable to all kinds of transistors, including the depletion type TFT. However, these pixel circuits do not have a threshold voltage compensation function and thus cannot solve the threshold voltage uniformity problem and the OLED's driving light emission uniformity problem caused by the process uniformity problem.

The oxide TFT is the development direction of the large AMOLED. The oxide TFT devices mostly have characteristics of the depletion type, that is, the threshold voltage of the N type is negative. FIG. 2 is the $I_{ds}$-$V_{gs}$ characteristic curve of the N type depletion TFT as known in the art, where $I_{ds}$ is the current between the TFT drain and source, and $V_{gs}$ is the voltage between the TFT gate and source. It can be seen from FIG. 2 that the most distinctive feature of the N type depletion TFT is that the threshold voltage is less than 0.

FIG. 3(*a*) is an AMOLED pixel driving circuit with a threshold voltage compensation function commonly seen in the art, wherein the gate of the driving TFT T1 is g, the source is s, the drain is d, C is a storage capacitor, D1 is a LED, VINI is an initial level signal, VDD is a high voltage level signal, VSS is a low voltage level signal, DATA is a data level signal, $G_n$ is a gate control signal of the TFTs T2 and T4 respectively, $G_{n-1}$ is a gate control signal of the TFT T5, and EM is a gate control signal of the TFTs T3 and T6 respectively. In a voltage programming stage, as shown in FIG. 3(*b*), the connection of T1 to the high voltage level signal VDD and the low voltage level signal VSS is cut off first, the terminal of the storage capacitor connected to the gate g of T1 is charged to the initial level voltage $V_{IN1}$, the terminal of the storage capacitor connected to the source s of T1 is charged to the data level voltage $V_{DATA}$, and then the gate g of the driving TFT T1 is connected to the drain d (i.e. turning on the transistor T4 in FIG. 3(*a*)) to form a diode connection manner to perform discharge, that is, to discharge the voltage between the two terminals of the storage capacitor from $V_{IN1}$-$V_{DATA}$ to the subthreshold turning on state $V_{TH}$, where $V_{TH}$ represents the threshold voltage of T1. When the driving TFT has a general characteristic of the enhancement type, the threshold voltage is positive, as shown in FIG. 4(*a*), and the voltage between the two terminals of the storage capacitor can be discharged to $V_{TH}$ normally to realize the threshold voltage compensation. However, when the driving TFT has the depletion type characteristic, the threshold voltage is negative, as shown in FIG. 4(*b*), when the voltage between the two terminals of the storage capacitor is discharged through the driving TFT connected to the diode, and the source-drain voltage of the driving TFT becomes zero cut-off, the voltage between the two terminals of the storage capacitor has not yet to be discharged to reach the subthreshold turning on state, in other words, the voltage between the two terminals of the storage capacitor is 0 but not $V_{TH}$ ($V_{TH}$<0). Therefore, the pixel driving threshold voltage compensation fails. Vds in FIG. 4(*a*) and FIG. 4(*b*) represents the voltage between the TFT drain and source.

To sum up, if a conventional AMOLED pixel driving circuit design of N type TFTs is applied to the depletion type TFT, when the threshold voltage is compensated for by using the diode connection manner, the threshold voltage compensation function would fail, because the threshold voltage is negative, and thus before the TFT enters the subthreshold saturation cutoff, the source-drain voltage becomes zero and the TFT is cut off in advance.

SUMMARY

Embodiments of the present disclosure provide an AMOLED pixel unit circuit, a driving method thereof and a display panel for realizing the threshold voltage compensation function.

An AMOLED pixel unit circuit of an embodiment of the present disclosure comprises:

a light emitting module configured to emit light under the driving of a driving current;

a driving module configured to drive the light emitting module;

a light emitting control module configured to turn on the light emitting module to make the light emitting module emit light;

a threshold compensation module configured to perform threshold voltage compensation for the driving module;

a data voltage writing module configured to input a data voltage to the driving module; and an initialization module configured to initialize the threshold compensation module.

A display panel of an embodiment of the present disclosure comprises said AMOLED pixel unit circuit.

An embodiment of the present disclosure also provides a driving method of a pixel unit circuit which comprises the active matrix light emitting diode pixel unit circuit, the driving method comprises:

an initialization step of initializing the threshold compensation module;

a data writing and threshold compensation step of inputting a data voltage to the driving module and performing the threshold voltage compensation for the driving module; and a display step of making the light emitting module emit light for displaying under the driving of the driving current.

To sum up, in the AMOLED pixel unit circuit, driving method thereof and the display panel according to embodiments of the present disclosure, the AMOLED pixel unit circuit comprises: a light emitting module; a driving module configured to drive the light emitting module; a light emitting control module configured to control the light emitting module to emit light; a threshold compensation module configured to perform threshold voltage compensation for the driving module; a data voltage writing module configured to input a data voltage to the driving module; and an initialization module configured to initialize the threshold compensation module. The threshold voltage compensation is realized by modifying the pre-charging fashion to fixedly set the gate of the driving TFT to be at a data level lower than the high level such that the subthreshold saturation cutoff state is reached before the drain-source voltage becomes zero in the compensation stage.

BRIEF DESCRIPTION OF THE DRAWINGS

FIG. 2 is the current-voltage characteristic curve diagram of the depletion type TFT as known in the art;

FIG. 3(*a*) and FIG. 3(*b*) are schematic diagrams of AMOLED pixel driving circuits with threshold voltage compensation function commonly seen in the art;

FIG. 4(*a*) is a schematic diagram for threshold voltage compensation of the circuit enhancement type TFT in the prior art; FIG. 4(*b*) is a schematic diagram for threshold voltage compensation failure of the circuit depletion TFT as known in the art;

FIG. 6 is a timing diagram of control signals of the AMOLED pixel unit circuit for the depletion type TFT threshold voltage compensation according to an embodiment of the present disclosure;

FIG. 7(*a*), FIG. 7(*b*) and FIG. 7(*c*) are schematic diagrams for operation principles of the AMOLED pixel unit circuit for the depletion type TFT threshold voltage compensation according to an embodiment of the present disclosure;

DETAILED DESCRIPTION

According to exemplary embodiments of the present disclosure, there is provided an AMOLED pixel unit circuit, a driving method thereof, and a display panel for realizing the threshold voltage compensation function.

In the following, detailed exemplary descriptions of the technical solutions of the embodiments of the present disclosure are given.

First Embodiment

Figure 1A:
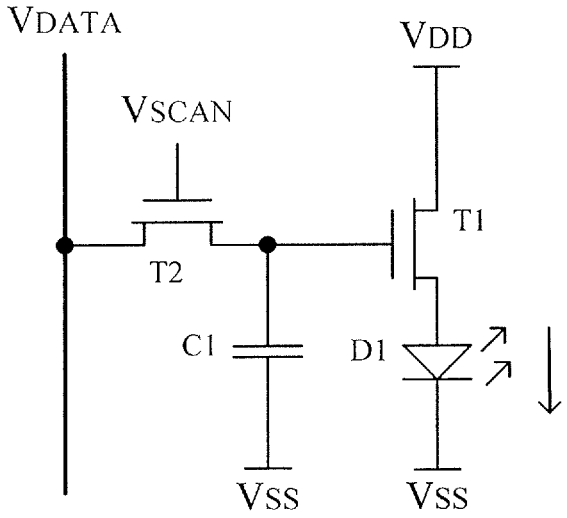
FIG. 1(*a*) and FIG. 1(*b*) are schematic diagrams of basic AMOLED pixel circuit structures as known in the art.
Figure 1B:
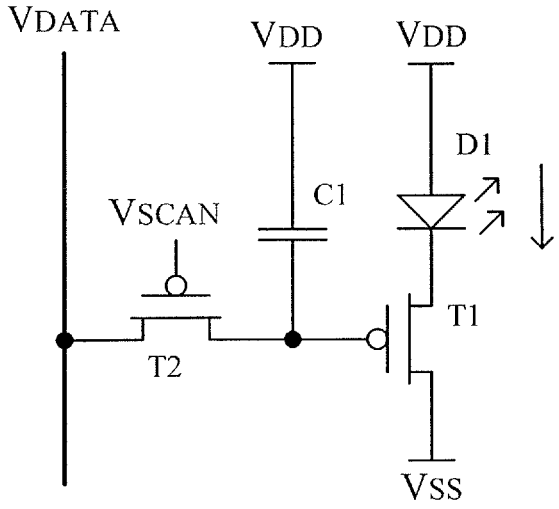
Figure 5:
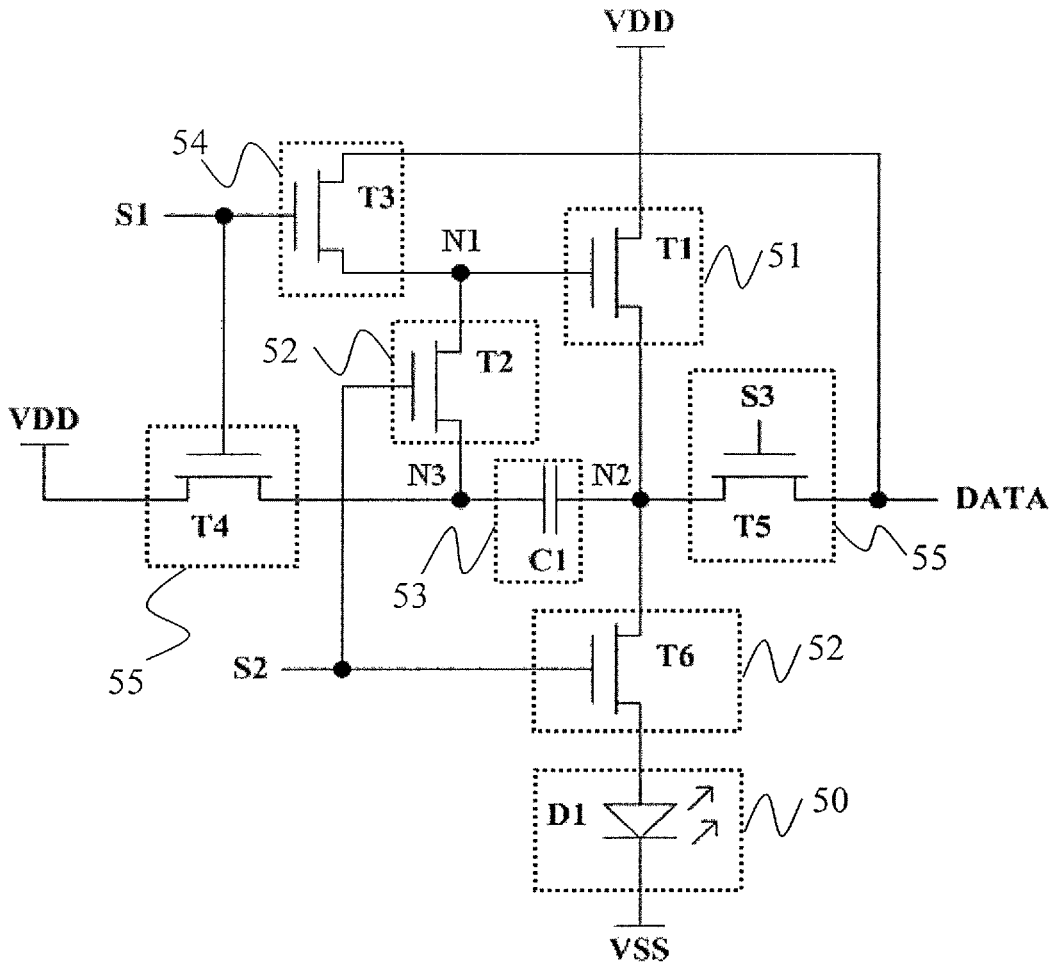
FIG. 5 is a schematic diagram of an AMOLED pixel unit circuit for depletion type TFT threshold voltage compensation according to an embodiment of the present disclosure.

Referring to FIG. 5, there is shown an AMOLED pixel unit circuit according to an embodiment of the present disclosure, comprising a light emitting module 50, a driving module 51, a light emitting control module 52, a threshold compensation module 53, a data voltage writing module 54 and an initialization module 55.

Herein, the driving module 51 is configured to drive the light emitting module 50; The light emitting control module 52 is configured to control the light emitting module 50 to emit light or not emit light; the threshold compensation module 53 is configured to perform threshold voltage compensation for the driving module 51; the data voltage writing module 54 is configured to input a data voltage to the driving module 51; and the initialization module 55 is configured to initialize the threshold compensation module 53.

Optionally, the driving module 51 comprises a first transistor T1 whose gate is connected to a first node N1 of the circuit and whose other two electrodes are connected to a second node N2 of the circuit and a high voltage level signal line (corresponding to a high voltage level signal VDD) respectively; in which the first node N1 is a common connection point of the driving module 51, the light emitting control module 52 and the data voltage writing module 54, and the second node N2 is a common connection point of the driving module 51, the light emitting control module 52, the threshold compensation module 53 and the initialization module 55.

Optionally, the light emitting control module 52 comprises a second transistor T2 and a sixth transistor T6, in which the gate of the second transistor T2 is connected to a second control signal line (corresponding to a second control signal S2 of the AMOLED pixel unit circuit), the other two electrodes of the second transistor T2 are connected to the first node N1 and a third node N3 respectively, the gate of the sixth transistor T6 is connected to the second control signal line (corresponding to a second control signal S2 of the AMOLED pixel unit circuit), the other two electrodes of the sixth transistor T6 are connected to the second node N2 and the light emitting module 50 respectively; the third node N3 is a common connection point of the initialization module 55, the light emitting control module 52 and the threshold compensation module 53.

Optionally, the light emitting module 50 comprises a light emitting diode D1 whose anode is connected to the light emitting control module 52 and whose cathode is connected to a low voltage level signal line (corresponding to a low voltage level signal VSS).

Optionally, the light emitting diode D1 is an organic light emitting diode.

Optionally, the threshold compensation module 53 comprises a storage capacitor C1, one terminal of the storage capacitor C1 is connected to the second node N2, and the other terminal is connected to the third node N3.

Optionally, the data voltage writing module 54 comprises a third transistor T3 whose gate is connected to a first control signal line (corresponding to a first control signal S1 of the AMOLED pixel unit circuit) and whose other two electrodes are connected to the first node N1 and a data signal line (corresponding to a data level signal VDATA) respectively.

Optionally, the initialization module 55 comprises a fourth transistor T4 and a fifth transistor T5, in which the gate of the fourth transistor T4 is connected to the first control signal line (corresponding to the first control signal S1 of the AMOLED pixel unit circuit), the other two electrodes of the fourth transistor T4 is connected to the high voltage level signal line (corresponding to the high voltage level signal VDD) and the third node N3 respectively, the gate of the fifth transistor T5 is connected to a third control signal line (corresponding to a third control signal S3 of the AMOLED pixel unit circuit), and the other two electrodes of the fifth transistor T5 is connected to the second node N2 and the data signal line (corresponding to the data level signal VDATA) respectively.

Optionally, the transistors T1, T2, T3, T4, T5 and T6 are all N type TFTs.

In the following, the principle of the AMOLED pixel unit circuit according to the first embodiment of the present disclosure will be described in connection with FIG. 6, FIG. 7(*a*), FIG. 7(*b*) and FIG. 7(*c*).

FIG. 6 is a timing diagram of the control signals of the AMOLED pixel unit circuit provided by an embodiment of the present disclosure. As shown in FIG. 6, S1 and S2 are control signals with opposite polarities, and S3 is an initialization control signal. The operation of the AMOLED pixel unit circuit comprises three stages: an initialization stage a, a data writing and threshold compensation stage b, and an OLED light emitting and displaying stage c.

In the initialization stage a, as shown in FIG. 6 and FIG. 7(*a*), the first control signal S1 and the third control signal i.e. the initialization control signal S3 are at a high level, the second control signal S2 is at a low level, DATA is the data level signal VDATA whose voltage is referred to as gray-scale voltage $V_{DATA}$ ($V_{SS}<V_{DATA}<V_{DD}$), where $V_{SS}$ is the voltage of the low voltage level signal VSS, and $V_{DD}$ is the voltage of the high voltage level signal VDD the transistors T3, T4 and T5 are turned on, and the transistors T2 and T6 are turned off. The gate of the transistor T1 is charged to $V_{DATA}$, the terminal of the storage capacitor C1 connected to the source of the transistor T1 is charged to $V_{DATA}$, the other terminal is charged to $V_{DD}$, and thus the voltage between the two terminals of the storage capacitor C1 is $V_{DD}-V_{DATA}$.

In the data writing and threshold compensation stage b, as shown in FIG. 6 and FIG. 7(*b*), S1 is at the high level, S2 and S3 are at the low level, the transistors T3 and T4 are turned on, and the transistors T2, T5 and T6 are turned off. The gate of the transistor T1 is kept at $V_{DATA}$. Since $V_{TH}<0$, the voltage between the two terminals of the storage C1 is still charged by the transistor T1 until T1 reaches the subthreshold saturation cutoff, that is, the source level of T1 becomes $V_{DATA}-V_{TH}$, where $V_{TH}$ represents the threshold voltage of T1. The other terminal of the storage capacitor C1 is kept as $V_{DD}$, and thus the voltage between the two terminals of the storage capacitor C1 is $V_{DD}-(V_{DATA}-V_{TH})=V_{DD}-V_{DATA}+V_{TH}$.

In the OLED light emitting and displaying stage c, as shown in FIG. 6 and FIG. 7(*c*), S2 is at the high level, S1 and S3 are at the low level, the transistors T3, T4 and T5 are turned off, and the transistors T2 and T6 are turned on. The gate-source voltage of the transistor T1 is $V_{DD}-V_{DATA}+V_{TH}$; therefore, the drain current of the transistor T1 is $$I_{DS} = \frac{1}{2}k\cdot(V_{DD} - V_{DATA} + V_{TH} - V_{TH})^2 = \frac{1}{2}k\cdot(V_{DD} - V_{DATA})^2$$

where k is preset constant. The light emitting diode D1 emits light for displaying under the driving of the drain current of the transistor T1, while the drain current of the transistor T1 is irrelevant to the threshold voltage, realizing the compensation for the threshold voltage of T1.

Figure 8:
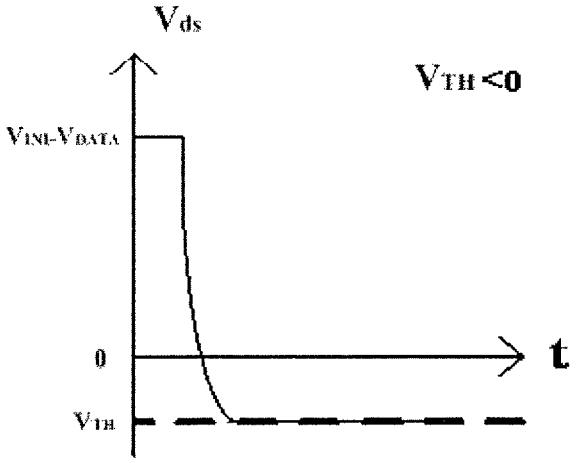
FIG. 8 is a schematic diagram of the implementation of the depletion type TFT threshold voltage compensation according to an embodiment of the present disclosure.

Since the above drain current of T1 is irrelevant to the threshold voltage, the depletion type TFT according to embodiments of the present disclosure can realize the threshold voltage compensation, as shown in FIG. 8. $V_{ds}$ in FIG. 8 represents the voltage between the TFT drain and the source of the TFT.

Second Embodiment

Figure 9:
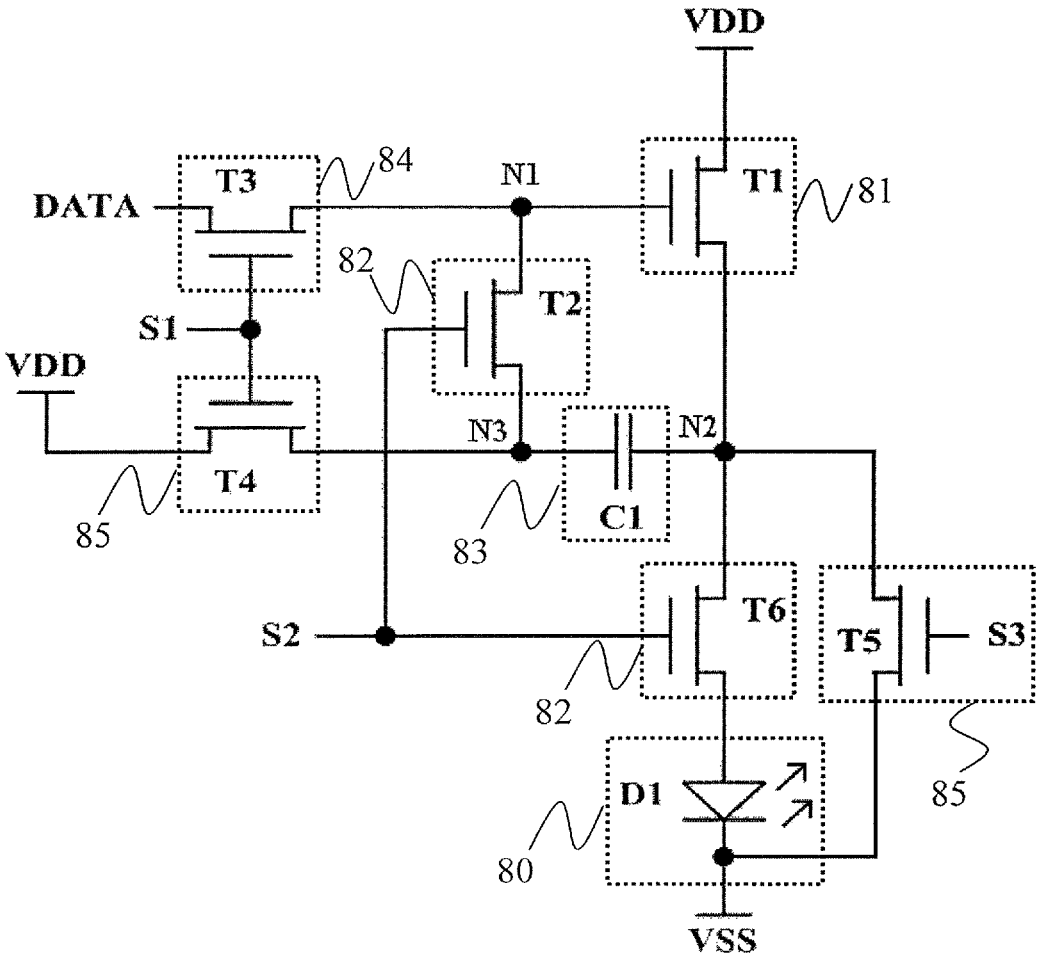
FIG. 9 is a schematic diagram of an AMOLED pixel unit circuit for depletion type TFT threshold voltage compensation according to another embodiment of the present disclosure.

Referring to FIG. 9, there is shown an AMOLED pixel unit circuit according to another embodiment of the present disclosure, comprising a light emitting module 80, a driving module 81, a light emitting control module 82, a threshold compensation module 83, a data voltage writing module 84 and an initialization module 85.

Herein, the driving module 81 is configured to drive the light emitting module 80; The light emitting control module 82 is configured to control the light emitting module 80 to emit light or not emit light; the threshold compensation module 83 is configured to perform threshold voltage compensation for the driving module 81; the data voltage writing module 84 is configured to input a data voltage to the driving module 81; and the initialization module 85 is configured to initialize the threshold compensation module 83.

Optionally, the driving module 81 comprises a first transistor T1 whose gate is connected to a first node N1 of the circuit and whose other two electrodes are connected to a second node N2 of the circuit and a high voltage level signal line (corresponding to a high voltage level signal VDD) respectively, in which the first node N1 is a common connection point of the driving module 81, the light emitting control module 82 and the data voltage writing module 84, and the second node N2 is a common connection point of the driving module 81, the light emitting control module 82, the threshold compensation module 83 and the initialization module 85.

Optionally, the light emitting control module 82 comprises a second transistor T2 and a sixth transistor T6, in which the gate of the second transistor T2 is connected to a second control signal line (corresponding to a second control signal S2 of the AMOLED pixel unit circuit), the other two electrodes of the second transistor T2 are connected to the first node N1 and a third node N3 respectively, the gate of the sixth transistor T6 is connected to the second control signal line (corresponding to a second control signal S2 of the AMOLED pixel unit circuit), the other two electrodes of the sixth transistor T6 are connected to the second node N2 and the light emitting module 80 respectively; the third node N3 is a common connection point of the initialization module 85, the light emitting control module 82 and the threshold compensation module 83.

Optionally, the light emitting module 80 comprises a light emitting diode DE one terminal of which is connected to the light emitting control module 82 and the other terminal of which cathode is connected to a low voltage level signal line (corresponding to a low voltage level signal VSS).

Optionally, the threshold compensation module 83 comprises a storage capacitor C1, one terminal of the storage capacitor C1 is connected to the second node N2, and the other terminal is connected to the third node N3.

Optionally, the data voltage writing module 84 comprises a third transistor T3 whose gate is connected to a first control signal line (corresponding to a first control signal S1 of the AMOLED pixel unit circuit) and whose other two electrodes are connected to the first node N1 and a data signal line (corresponding to a data level signal VDATA) respectively.

Optionally, the initialization module 85 comprises a fourth transistor T4 and a fifth transistor T5, in which the gate of the fourth transistor T4 is connected to the first control signal line (corresponding to the first control signal S1 of the AMOLED pixel unit circuit), the other two electrodes of the fourth transistor T4 is connected to the high voltage level signal line (corresponding to the high voltage level signal VDD) and the third node N3 respectively, the gate of the fifth transistor T5 is connected to a third control signal line (corresponding to a third control signal S3 of the AMOLED pixel unit circuit), and the other two electrodes of the fifth transistor T5 is connected to the second node N2 and the low voltage level signal line (corresponding to the low voltage level signal VSS) respectively.

Optionally, the anode of the light emitting diode D1 is connected to the sixth transistor T6, and the cathode thereof is connected to the low voltage level signal line (corresponding to the low voltage level signal VSS).

Optionally, the transistors T1, T2, T3, T4, T5 and T6 are all N type TFTs.

The operation principle of the circuit of the second embodiment of the present disclosure is the same as the operation principle of the circuit of the first embodiment of the present disclosure with the only exception that the terminal of the capacitor C1 connected to the source of the transistor T1 is charged to different voltages during the initialization. Therefore, it will not be described here to avoid repetition.

An embodiment of the present disclosure also provides a display panel comprising said AMOLED pixel unit circuit.

An embodiment of the present disclosure also provides a driving method of a pixel unit circuit which comprises the above mentioned active matrix light emitting diode pixel unit circuit, the driving method comprises the following steps:

an initialization step of initializing the threshold compensation module;

a data writing and threshold compensation step of inputting a data voltage to the driving module and performing the threshold voltage compensation for the driving module; and a display step of making the light emitting module emit light for displaying under the driving of the driving current.

To sum up, in the AMOLED pixel unit circuit, driving method thereof and the display panel according to embodiments of the present disclosure, the AMOLED pixel unit circuit comprises: a light emitting module; a driving module configured to drive the light emitting module; a light emitting control module configured to control the light emitting module to emit light; a threshold compensation module configured to perform threshold voltage compensation for the driving module; a charging module configured to charge the threshold compensation module; and a data voltage writing module configured to input a data voltage to the driving module. The threshold voltage compensation is realized by modifying the pre-charging fashion to fixedly set the gate of the driving TFT to be at a data level lower than the high level such that the subthreshold saturation cutoff state is reached before the drain-source voltage becomes zero in the compensation stage.

Although description is made by taking the organic light emitting diode as an example in the above embodiments, those skilled in the art should understand that the above pixel circuits can be applied to the driving of other light emitting diodes (such as inorganic light emitting diodes), but are not limited to the organic light emitting diode.

Obviously, those skilled in the art can make various modifications and variations without departing from the spirit and scope of the present disclosure. The present disclosure is also intended to contain those modifications and variations as long as those modifications and variations of the present disclosure fall within the scope of the claims and equivalents thereof of the present disclosure.

What is claimed is:

1. An active matrix light emitting diode pixel unit circuit, comprising:

a light emitting module configured to emit light under the driving of a driving current;

a driving module configured to drive the light emitting module;

a light emitting control module configured to turn on the light emitting module to make the light emitting module emit light;

a threshold compensation module configured to perform threshold voltage compensation for the driving module;

a data voltage writing module configured to input a data voltage to the driving module; and an initialization module configured to initialize the threshold compensation module;

wherein the driving module, the light emitting control module and the data voltage writing module are commonly connected to a first node of the circuit; the driving module, the light emitting control module, one terminal of the threshold compensation module and the initialization module are commonly connected to a second node of the circuit; and the initialization module, the light emitting control module and the other terminal of the threshold compensation module are commonly connected to a third node of the circuit.

2. The circuit according to claim 1, wherein the driving module comprises a first transistor whose gate is connected to a first node of the circuit and whose other two electrodes are connected to a second node of the circuit and a high voltage level signal line respectively.

3. The circuit according to claim 2, wherein the light emitting control module comprises a second transistor and a sixth transistor, the gate of the second transistor is connected to a second control signal line, the other two electrodes of the second transistor are connected to the first node and a third node respectively, the gate of the sixth transistor is connected to the second control signal line, the other two electrodes of the sixth transistor are connected to the second node and the light emitting module respectively.

4. The circuit according to claim 3, wherein the light emitting module comprises a light emitting diode whose anode is connected to the light emitting control module and whose cathode is connected to a low voltage level signal line.

5. The circuit according to claim 4, wherein the light emitting diode is an organic light emitting diode.

6. The circuit according to claim 2, wherein the threshold compensation module comprises a storage capacitor, one terminal of the storage capacitor is connected to the second node, and the other terminal is connected to the third node.

7. The circuit according to claim 2, wherein the data voltage writing module comprises a third transistor whose gate is connected to a first control signal line and whose other two electrodes are connected to the first node and a data signal line respectively.

8. The circuit according to claim 2, wherein the initialization module comprises a fourth transistor and a fifth transistor, the gate of the fourth transistor is connected to a first control signal line, the other two electrodes of the fourth transistor is connected to the high voltage level signal line and the third node respectively, the gate of the fifth transistor is connected to a third control signal line, and the other two electrodes of the fifth transistor is connected to the second node and a data signal line respectively.

9. The circuit according to claim 2, wherein the initialization module comprises a fourth transistor and a fifth transistor, the gate of the fourth transistor is connected to a first control signal line, the other two electrodes of the fourth transistor is connected to the high voltage level signal line and the third node respectively, the gate of the fifth transistor is connected to a third control signal line, and the other two electrodes of the fifth transistor is connected to the second node and a low voltage level signal line respectively.

10. The circuit according to claim 2, wherein all the transistors are N type thin film transistors (TFTs).

11. A display panel comprising an active matrix light emitting diode pixel unit circuit according to claim 1.

12. The display panel according to claim 11, wherein the driving module comprises a first transistor whose gate is connected to a first node of the circuit and whose other two electrodes are connected to a second node of the circuit and a high voltage level signal line respectively.

13. The display panel according to claim 12, wherein the light emitting control module comprises a second transistor and a sixth transistor, the gate of the second transistor is connected to a second control signal line, the other two electrodes of the second transistor are connected to the first node and a third node respectively, the gate of the sixth transistor is connected to the second control signal line, the other two electrodes of the sixth transistor are connected to the second node and the light emitting module respectively.

14. The display panel according to claim 13, wherein the light emitting module comprises a light emitting diode whose anode is connected to the light emitting control module and whose cathode is connected to a low voltage level signal line.

15. The display panel according to claim 14, wherein the light emitting diode is an organic light emitting diode.

16. The display panel according to claim 12, wherein the threshold compensation module comprises a storage capacitor, one terminal of the storage capacitor is connected to the second node, and the other terminal is connected to the third node.

17. The display panel according to claim 12, wherein the data voltage writing module comprises a third transistor whose gate is connected to a first control signal line and whose other two electrodes are connected to the first node and a data signal line respectively.

18. The display panel according to claim 12, wherein the initialization module comprises a fourth transistor and a fifth transistor, the gate of the fourth transistor is connected to a first control signal line, the other two electrodes of the fourth transistor is connected to the high voltage level signal line and the third node respectively, the gate of the fifth transistor is connected to a third control signal line, and the other two electrodes of the fifth transistor is connected to the second node and a data signal line respectively.

19. The display panel according to claim 12, wherein the initialization module comprises a fourth transistor and a fifth transistor, the gate of the fourth transistor is connected to a first control signal line, the other two electrodes of the fourth transistor is connected to the high voltage level signal line and the third node respectively, the gate of the fifth transistor is connected to a third control signal line, and the other two electrodes of the fifth transistor is connected to the second node and a low voltage level signal line respectively.

20. A driving method of a pixel unit circuit which is an active matrix light emitting diode pixel unit circuit according to claim 1, the driving method comprising:

an initialization step of initializing the threshold compensation module;

a data writing and threshold compensation step of inputting a data voltage to the driving module and performing the threshold voltage compensation for the driving module; and a display step of making the light emitting module emit light for displaying under the driving of the driving current.

* * * * *